United States Patent [19]

Bromley

[11] Patent Number: 5,026,058

[45] Date of Patent: Jun. 25, 1991

[54] ELECTRONIC BASEBALL GAME APPARATUS

[76] Inventor: Eric Bromley, 4 Watson Dr., West Simsbury, Conn. 06092

[21] Appl. No.: 333,569

[22] Filed: Mar. 29, 1989

[51] Int. Cl.[5] ..... A63F 9/00

[52] U.S. Cl. ..... 273/93 C; 273/88; 273/88 G; 273/460

[58] Field of Search ..... 273/88, 93 R, 93 C, 273/94, 85 G, 85 R, 1 E, 237

[56] References Cited

U.S. PATENT DOCUMENTS

| | | | |
|---|---|---|---|
| 4,185,825 | 1/1980 | Bromley . | |
| 4,195,838 | 4/1980 | Santandrea et al. . | |
| 4,249,734 | 2/1981 | Bromley . | |
| 4,249,735 | 2/1981 | Bromley | 273/94 |
| 4,249,744 | 2/1981 | Bromley | 273/85 G |
| 4,261,569 | 4/1981 | Frohlich | 273/93 C |
| 4,327,915 | 5/1982 | Bromley | 273/94 |
| 4,366,960 | 1/1983 | Bromley et al. | 273/85 G |
| 4,381,864 | 5/1983 | Bromley et al. | 273/88 |
| 4,386,776 | 6/1983 | Bromley | 273/85 G |
| 4,391,444 | 7/1983 | Bromley | 273/94 |
| 4,462,594 | 7/1984 | Bromley et al. | 273/85 G |
| 4,552,360 | 11/1985 | Bromley et al. | 273/85 G |
| 4,653,755 | 3/1987 | Panella et al. | 273/93 R |
| 4,662,635 | 5/1987 | Enokian . | |
| 4,672,541 | 6/1987 | Bromley et al. | 364/410 |
| 4,681,548 | 7/1987 | Lemelson | 434/311 |
| 4,729,564 | 3/1988 | Kuna et al. | 273/1 E |
| 4,840,382 | 6/1989 | Rubin | 273/237 |

FOREIGN PATENT DOCUMENTS

| | | | |
|---|---|---|---|
| 0108748 | 8/1979 | Japan | 273/88 |
| 8302566 | 8/1983 | PCT Int'l Appl. | 273/88 |
| 2033763 | 5/1980 | United Kingdom | 273/88 |
| 2161629 | 1/1986 | United Kingdom . | |

OTHER PUBLICATIONS

"Strat-O-Matic Baseball", Newsweek, Aug. 1976, p. 60.

Batter Up! Baseball Instructions (5 Pages).

*Primary Examiner*—Esward M. Coven

*Assistant Examiner*—Jessica J. Harrison

*Attorney, Agent, or Firm*—Fishman, Dionne & Cantor

[57] ABSTRACT

An electronic baseball game is presented which permits the human operators to input individualized attributes or statistical information relative to the batter, runner and pitcher based on real or fictionalized baseball players. In a preferred embodiment, this statistical information is encoded as a bar code printed on a sticker. In turn, the sticker is placed on the edge of a card, preferably a standard baseball card. The bar code contains information as to the batting average, right of left handed batting and pitching, pitching speed, running speed and hitting power. The statistical information on the bar coded card is then entered into the electronic baseball game by sliding the card through a slot containing a conventional photo optical bar code reader. The statistical information is then used by the computer program in the game to regulate and interact with the playing activity of the human players. Thus, in accordance with the present invention, a baseball card can act as a programmable means to enter supplementary information into an electronic baseball game to thereby effect the gameplay. The electronic baseball game of the present invention also includes a scoreboard, liquid crystal display (LCD) playing field and a plurality of switches which allow the human player to select a desired type of pitch (e.g. change-up, off-speed or fast ball); to steal a base or pick-off a base runner; to send in a relief pitcher; to bunt or execute a double play and of course, to initiate the actual pitching and batting actions.

34 Claims, 14 Drawing Sheets

ELECTRONIC BASEBALL GAME APPARATUS

BACKGROUND OF THE INVENTION

This invention relates generally to the field of electronic games, in general, electronic sport simulation games. More particularly, this invention relates to an electronic game of the type that simulates baseball.

It is desirable in game devices for simulating athletic contests that they provide the operator with a sense of playing the game by requiring actions that are analogous to those that he would take if he were playing the real game. Consequently, devices for simulating the game of baseball have employed numerous ways of simulating batting. The most apparent way to simulate batting is exemplified in the pinball-type games, in which a mechanical lever controlled by the operator pivots in an attempt to hit an actual rolling ball. This type of game has the advantage that the operator performs a realtime function that is similar to the swinging action that a batter actually performs, but the mechanical, moving parts used to display the action are not desirable in all types of games. Furthermore, most examples of this type of game only permit the operator to choose the time at which the swing is to be performed, not the force of the swing.

Other types of games avoid the use of a moving ball and a lever; instead, they determine the outcome of a simulated swing in a somewhat random manner. This type of game is exemplifield by the board game illustrated in U.S. Pat. No. 2,825,564 to Macht et al., which simulates a choice by the operator of the type of swing that is to be performed. The Macht et al apparatus uses a spinner to determine swing outcome, so the operator does not time the swing in a real-time fashion, and the choices of swing type, although not so named, are in essence guesses at the type of pitch selected by the defensive operator. Although this type of game does simulate some of the features of baseball, it is clear that the action in this game is somewhat removed from the action of the batter in the real game.

The advance of technology has brought electricity into this game field, and the early electrical games are exemplified by the device illustrated in U.S. Pat. No. 3,655,189 to Alexander. In that game, numerous relay controlled circuits determine the outcome in a pseudo-random manner based on the guesses of the offensive operator at the type of pitch selected by the defensive operator. Depending on the match up, different outcome probabilities are chosen.

Further advances have resulted in electronic games for simulating baseball. An example of such a device is described in U.S. Pat. No. 3,680,239 to Feuer et al. In the Feuer et al device the outcome of a simulated swing is determined by the time at which the key actuation representing the swing occurs.

U.S. Pat. No. 4,381,864 to Bromley et al discloses an electronic baseball which has improved playing features including switches for signaling the occurrence of a batter swing as well as further switches for indicating the type of swing to be simulated.

However, notwithstanding the advances and improvements in the field of electronic baseball and other athletic games, there continues to be a need for new and improved electronic baseball games which more closely resemble the actual game of baseball and provide the player with more personal input and control over the playing action on the electronic field display.

SUMMARY OF THE INVENTION

The above-discussed and other drawbacks and deficiencies of the prior art are overcome or alleviated by the electronic baseball game of the present invention. In accordance with the present invention, an electronic baseball game is presented which permits the human operators to input individualized physical attributes based on either statistical or other information on the batter and pitcher; the result of which serves to characterize an individual player. The batters and pitchers may be based on real or fictionalized baseball players. In a preferred embodiment, this statistical information is encoded as a bar code printed on a sticker. In turn, the sticker is placed on the edge of a card, preferably a standard baseball card. The bar code contains information as to the batting average, right or left handed batting and pitching, pitching speed, running speed and hitting power. The statistical information on the bar coded card is then entered into the electronic baseball game by sliding the card through a slot containing a conventional photo optical bar code reader. The statistical information is then used by the computer program in the game to regulate and interact with the playing activity of the human operators. Thus, in accordance with the present invention, a baseball card can act as a supplimentary programmable means to enter information into an electronic baseball game to thereby effect and modify the gameplay.

The electronic baseball game of the present invention also includes a scoreboard, liquid crystal display (LCD) playing field and a plurality of switches which allow the human player to select a desired type of pitch (e.g. change-up, off-speed or fast ball); to steal a base or pick-off a base runner; to send in a relief pitcher; to bunt or execute a double play and of course, to initiate the actual pitching and batting actions.

The present invention may be played with one or two operators and also includes both defensive and offensive team statistics permanently stored in memory so that the game may be played with or without the use of supplementary programmable means, e.g., bar coded playing cards.

The above-discussed and other features and advantages of the present invention will be appreciated and understood from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
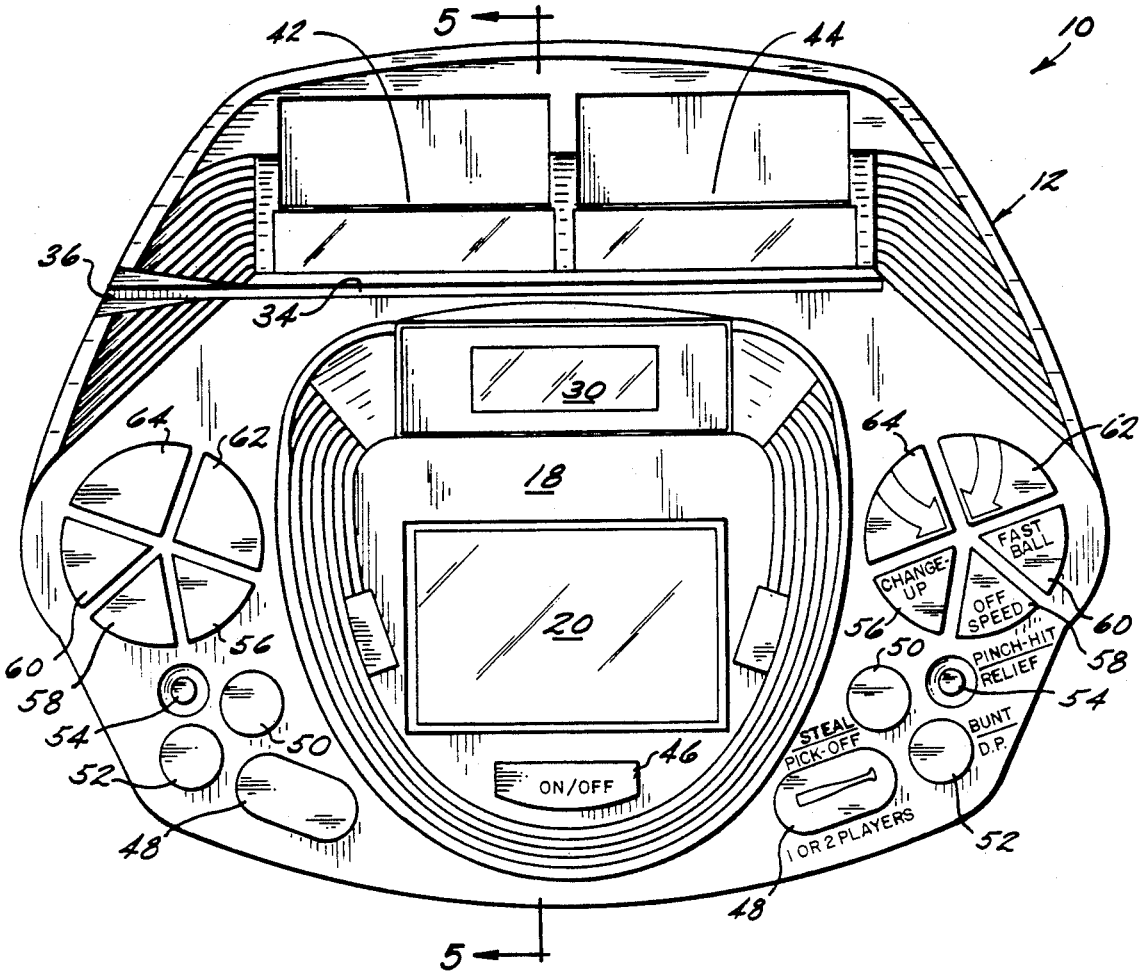
FIG. 1 is a top plan view of an electronic baseball game in accordance with the present invention.
Figure 2:
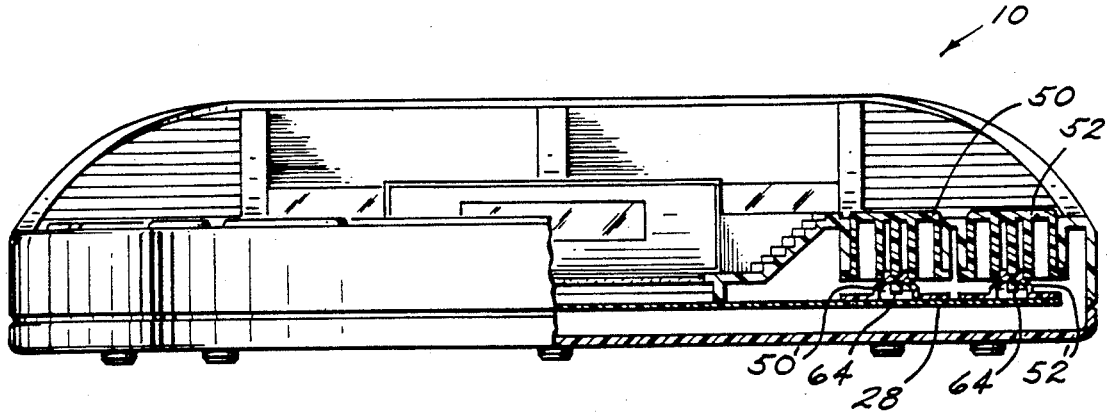
FIG. 2 is a side elevation view, partly in cross-section, of the baseball game of FIG. 1.
Figure 3:
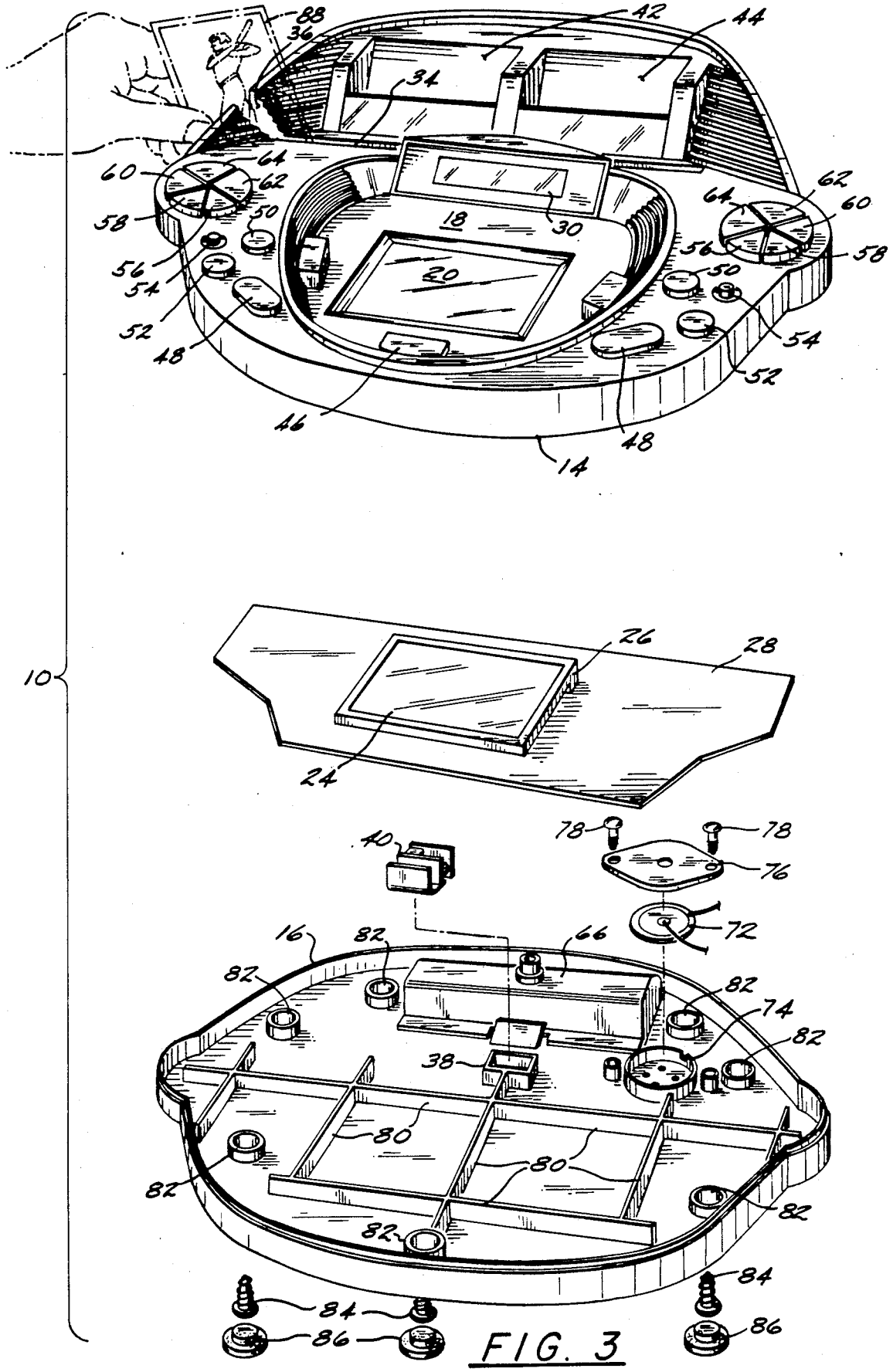
FIG. 3 is an exploded perspective view of the baseball game of FIG. 1.

Referring jointly to FIGS. 1-5, an electronic baseball game in accordance with the present invention is shown generally at 10. Baseball game 10 comprises a two piece, preferably molded housing 12 having an upper portion 14 and a lower portion 16 (see FIG. 3). Upper housing portion 14 has a central recessed area 18 resembling a stadium. Recessed area 18 includes a clear plastic overlay 20 which covers a playing field defined by a graphic underlay (see item 22 in FIG. 6) laminated to a LCD playfield display (see item 24 in FIG. 7). As shown in FIG. 3, graphic underlay 22 and LCD displaY 24 are housed in a frame 26 mounted on a printed circuit board 28 which is sandwiched between upper and lower housing portions 14 and 16 on assembled housing 12. Recessed area 18 also includes a clear plastic overlay 30 which covers a scoreboard LCD display 32 as best seen in FIG. 8.

Figure 9B:
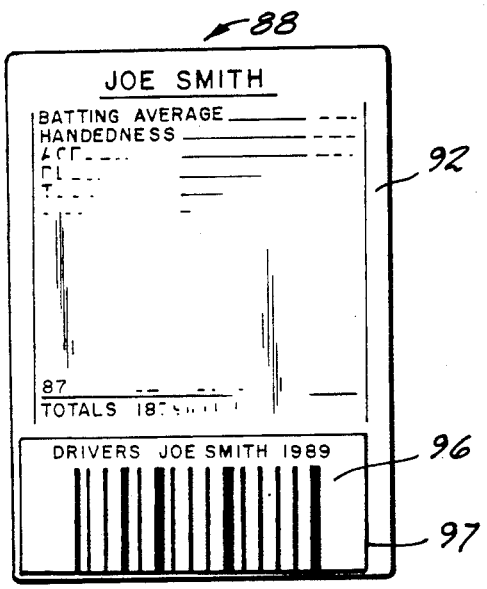
FIG. 9B is a rear elevation view of the baseball card of FIG. 9A.
Figure 9A:
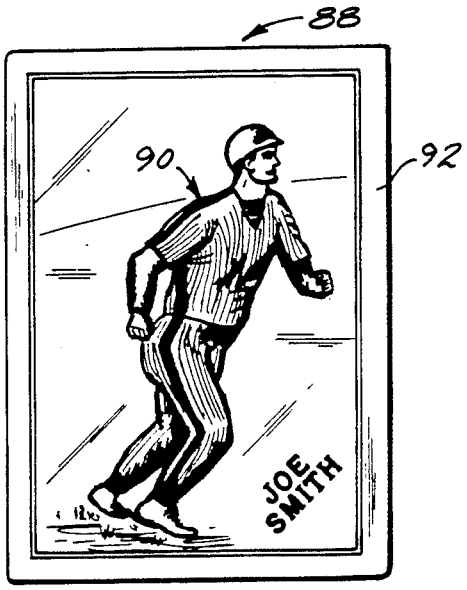
FIG. 9A is a front elevation view of a baseball card for use with the baseball game of FIG. 1.

Upper housing portion 14 also includes a slot 34 which terminates on one side of the housing at a widened entrance section 36. Slot 34 has a width which allows it to receive a card (see item 88 in FIG. 3 and FIGS. 9A and 9B) and permit the card to slide through the slot.

The rear section of upper housing portion 14 includes a pair of card retaining sleeves 42 and 44. These sleeves will retain and display a respective card (see FIG. 4) to indicate the particular pitcher and batter being played as will be discussed in more detail below.

Figure 11A:
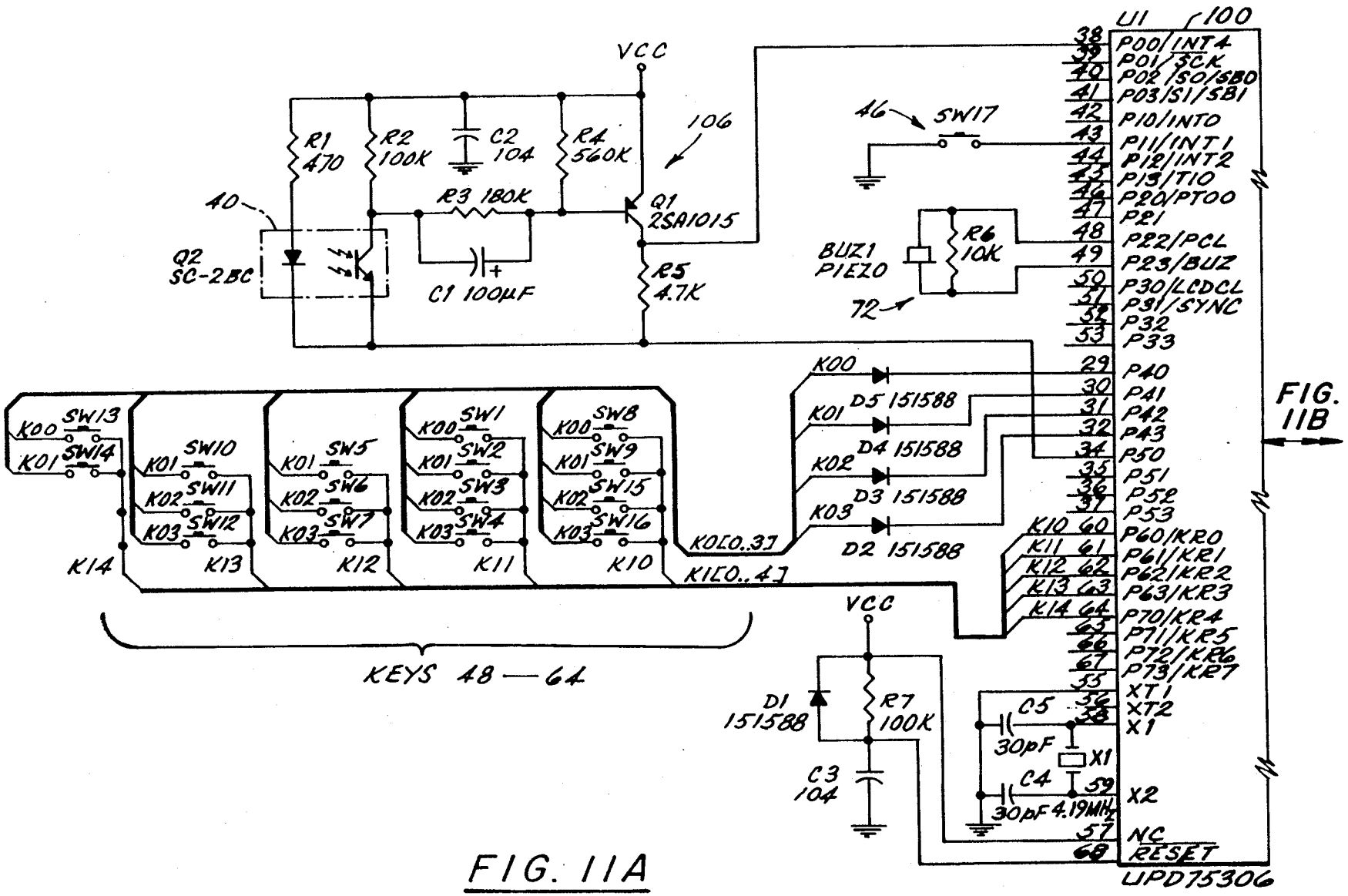
FIG. 11A and 11B is an electronic schematic of the baseball game of FIG. 1.
Figures 11A, 11B:
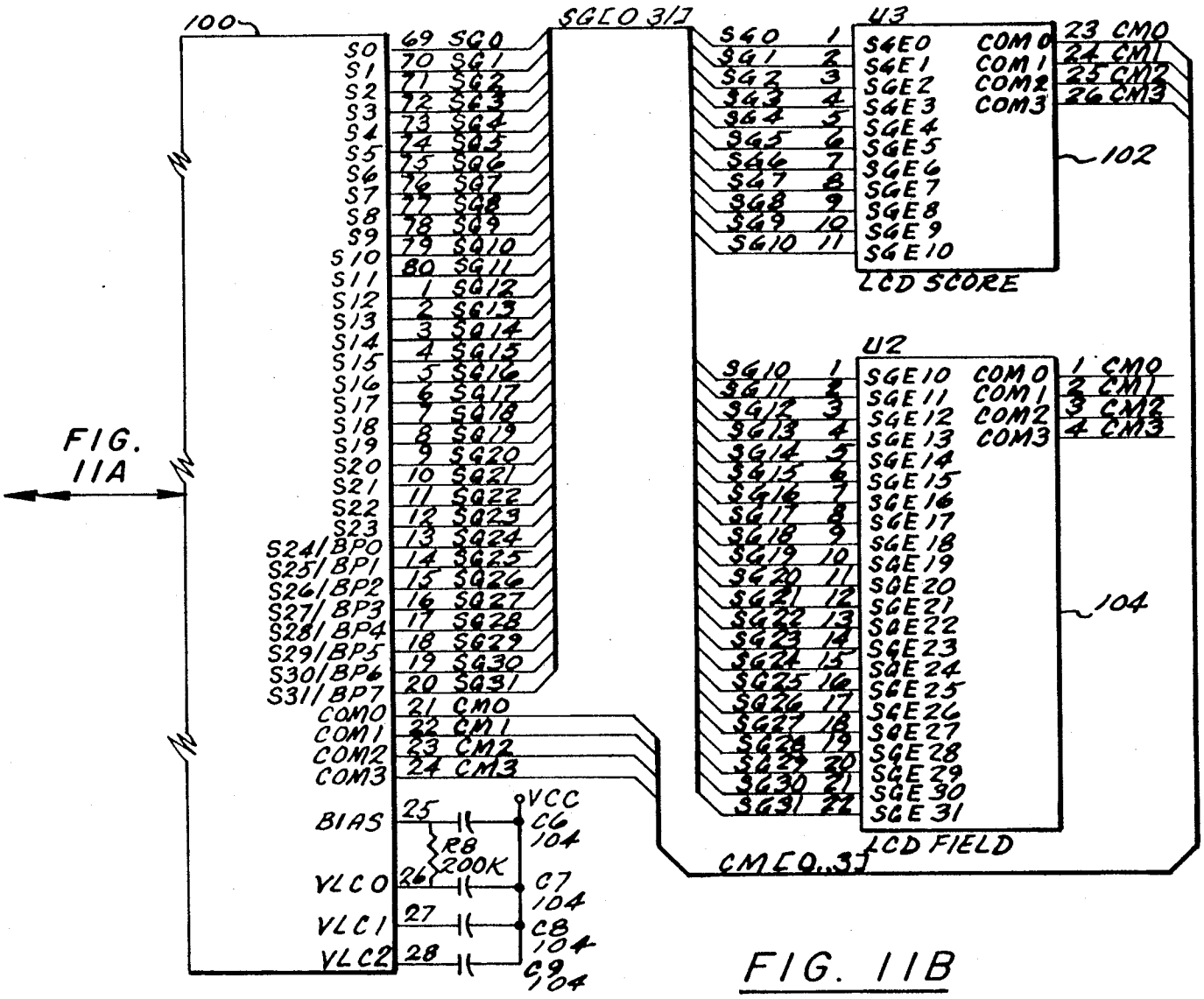

Lower housing portion 14 includes a molded-in-support 38 which receives a conventional bar code sensor 40 such as a Kodenshi SG-2BC (see FIGS. 11A and 11B).

Figure 5:
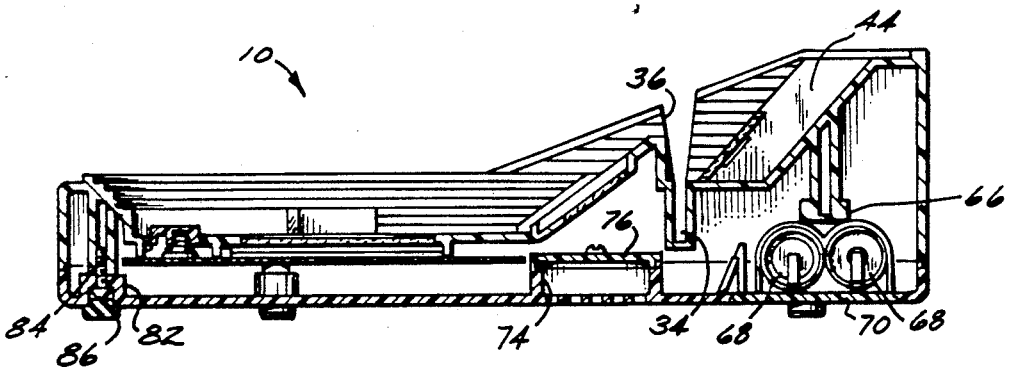
FIG. 5 is a cross-sectional elevation view along the line 5—5 of FIG. 1.
Figure 6:
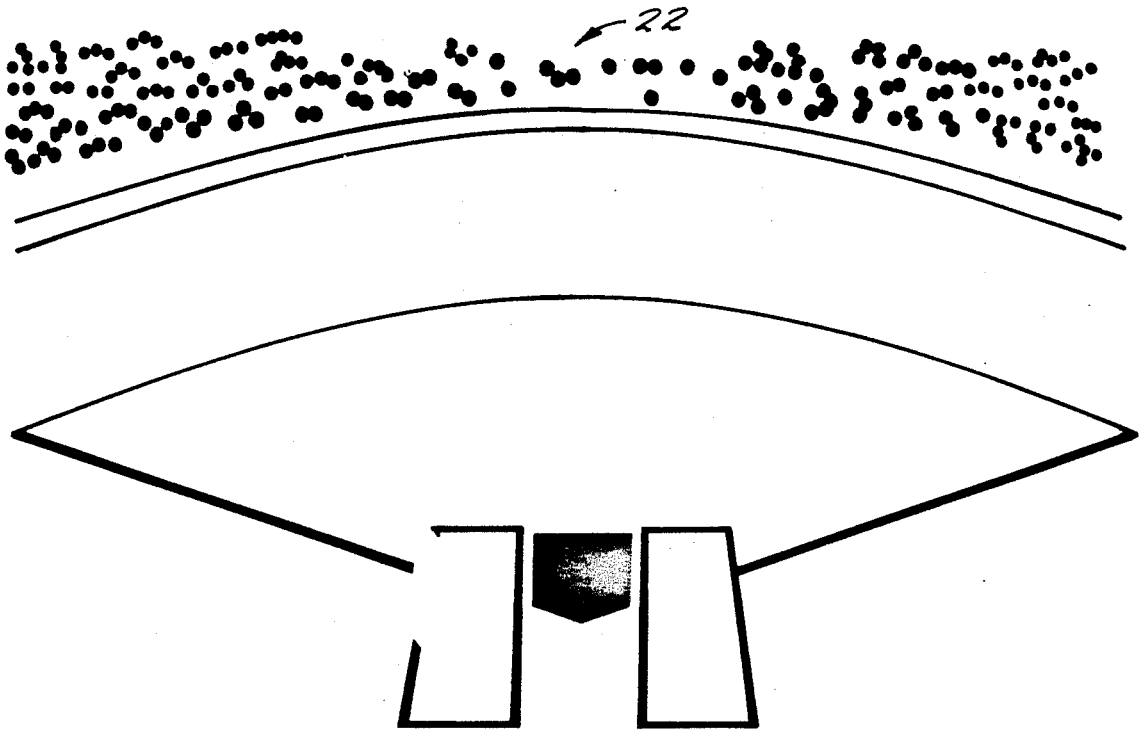
FIG. 6 is a plan view of the baseball playing field overlay.

Lower housing portion 16 further includes a retainer 66 for housing a power source which preferably consists of four AA alkaline batteries, two of which are shown at 68 in FIG. 5. Batteries 68 are held in retainer 66 (and removed therefrom) by a battery cover 70. A sound device is also located in housing portion 16. This sound device comprises a commercially available piezo 72 which is received in a cylindrical support 74 and retained therein by a piezo cover 76 and a pair of threaded fasteners 78. A plurality of transverse support ribs 80 extend upwardly from the base of housing portion 16 to support circuit board 28. Seven fastener sleeves 82 also extend upwardly from the interior base of housing portion 16. Sleeves 82 guide screw fasteners 84 into corresponding sleeves positioned within housing portion 14 to retain the two housing portions 14 and 16 together (see FIG. 5). Finally, a rubber foot 86 is frictionally engaged in each sleeve 82 to act as a support for housing 12.

Figure 4:
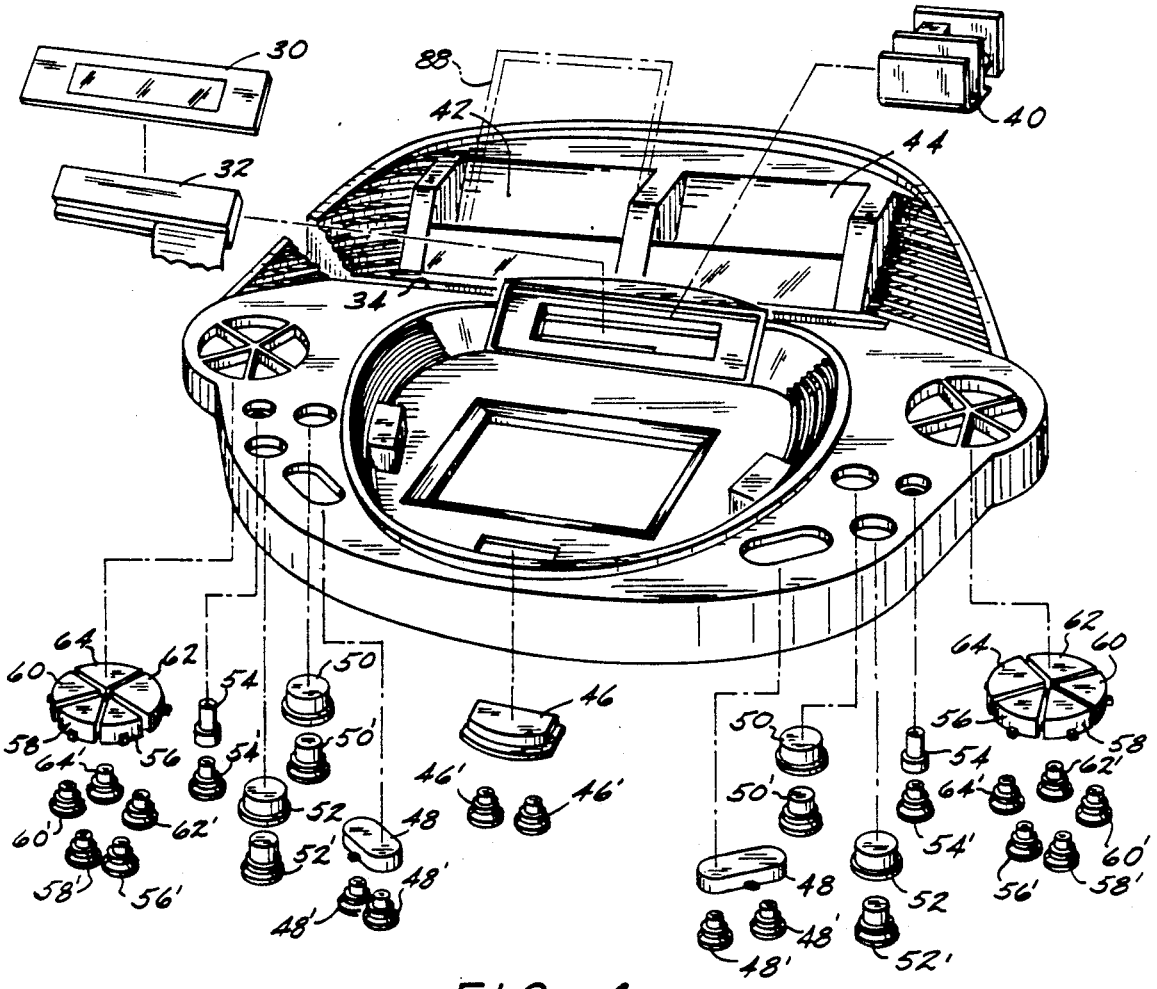
FIG. 4 is another exploded perspective view of the baseball game of FIG. 1.

There are a total of nineteen keys; nine keys for each player and the power on/off switch. The nine key set is duplicated for each player and used for both the batting team and the pitching team so that the human operators do not need to change positions between innings. As shown in FIG. 4, each key comprises a rigid plastic housing which is depressed by the finger of a human player. The rigid plastic housing is seated on an elastomeric dome shaped member having conductive material along its upper inside surface. The elastomeric dome is positioned on a preselected circuit trace on circuit board 28 so that upon actuation, a circuit is closed as shown in the circuit diagram of FIGS. 11A and 11B.

Turning now to a description of specific keys, the ON/OFF power key 46 is positioned in the central recessed area 18 and is associated with a pair of elastomeric dome members 46'. A pair of oval keys 48 (also associated with two domed members 48') have two functions including determining one player or two players and controlling bat swing. A pair of keys 50 have dual functions of controlling base stealing by the offensive team and pick-off attempts by the defensive team. A pair of keys 52 have the dual functions of controlling bunting for the offensive team and controlling double play action for the defensive team. Keys 54 permit the defensive team to substitute a relief pitcher.

Five wedged shape switches arranged in a circle control the pitching. Switches 56, 58 and 60 select the type of pitch including change-up, off speed and fast ball, respectively. Switches 62 and 64 control curvature of the pitch to the right (switch 62) or to the left (switch 64).

As mentioned and shown in the drawings, each switch or key is associated with an elastomeric domed element. Referring to FIG. 2, keys 50 and 52 are depicted in cross-section. Each elastomeric element 50' and 52' includes a conductive element 64 on its upper interior surface so that when keys 50 or 52 are depressed, elastomeric dome 50' or 52' will deform and cause conductive element 64 to contact circuit board 28 thereby completing a circuit.

Turning now to FIG. 8, LCD scoreboard 32 comprises a 64 segment LCD display. Scoreboard 32 will indicate the following:

Count (strikes, balls, outs)
Inning (maximum of 19)
Score (maximum of 29)
Batting Position
Team at bat (home team or visiting team)
Batting Average Legends (INNING, BATTING, SCORE and AVERAGE) are also provided. These legends will selectively be lit to interpret the meaning of the associated segmented numerical characters, some of which have been limited to one or two segments to reduce the input/output (1/0) line count. Scoreboard 30 thus limits the number of 1/0 lines in the LCD necessary to display the required information thus leading to lower costs.

In addition to the score board indicators, the LCD playfield 24 (FIG. 7) indicates the value of the hit by base runner movement (e.g. single, double, triple, and homerun) and indicates "out". "foul-ball", "strike" and "homerun". The LCD playfield display 24 also depicts handedness (right or left) for the batter and the pitcher.

LCD playfield provides animated batted ball routes by sequentially lighting specific ball indicators creating the illusion of a batted ball. For example, if the batter were to make a hit to the left, the balls intersected by the line identified by the numeral 200 would be sequentially lit to indicate ball movement. Similarly, if a batter were to make a hit to right field, the balls intersected by the line identified by the numeral 202 would be sequentially lit to indicate ball movement. The effect of the operator's bat timing (early or later) and pitch location will therefore have an effect on the batted ball direction. Of course, the operator's bat timing is controlled by actuation of bat switch 48.

An important feature of the present invention is the ability to input programmed individualized statistical information for each batter and pitcher. In a preferred embodiment, this is accomplished through the novel use of baseball cards and bar codes as shown at 88 in FIGS. 9A and 9B. Baseball card 88 may be a conventional known baseball card which includes a photograph of a baseball player 90 on the front side 92 thereof and a backside 94 which preferably contains statistical information on the baseball player 90 depicted on the front. A bar code 96 is positioned on the lower portion of back surface 92 so that it may be easily read by bar code reader 40 when slid through slot 34 (see FIG. 3). Bar code 96 may be printed directly on card 88 or, more preferably, may be printed on an adhesive sticker 97 which is then applied to card 92. In this way, the statistical information for a given player may be continually updated from year to year simply by removing the old bar coded sticker and applying a new sticker.

Figure 10:
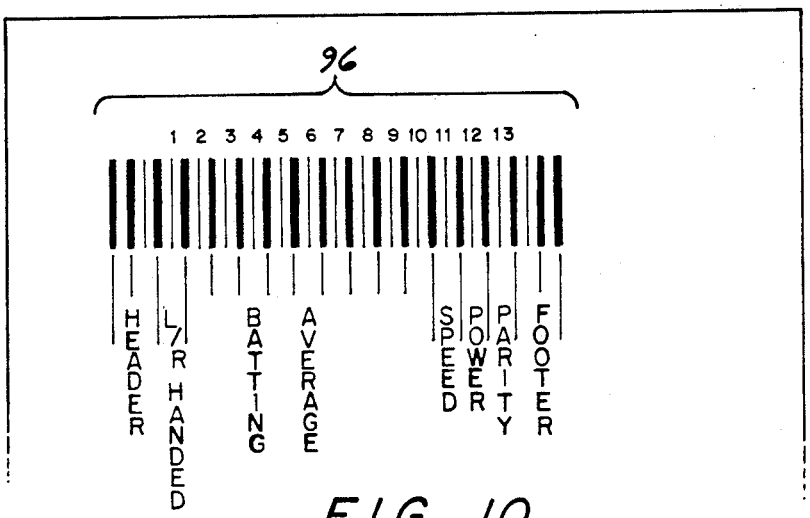
FIG. 10 is an enlarged view of the bar code depicted on the baseball card of FIG. 9B.

In FIG. 10, a breakdown of information encoded on a bar code for use with the present invention is shown. The bar code includes a conventional "header" and "footer" for instructing the bar code reader to begin and end reading. Within the header and footer is bar encoded information relative to:

Handedness (left or right)
Batting average
Speed
Power
Parity

The "parity" code is used for checking read errors in a known standard manner.

In FIGS. 11A and 11B, an electronic schematic of circuit board 28 is shown. The baseball game of this invention is controlled by an integrated circuit microprocessor 100 which is preferably a NEC UPD75306 connected to LCD drivers 102 (scoreboard) and 104 (playfield). Bar code reader 40 is connected to a series of resistors R1–R5, a transistor 106 (such as a Toshiba 2SA1015 GR), capacitor C1 (100 micro F 16V) and a capacitor C2. The several switches 48–64, are connected to microprocessor 100 via four diodes D2–D5 (such as a Toshiba 1SA1588). A power-up reset circuit 108 is comprised of a diode D1, resistor R7 and ceramic capacitor C3. FIG. 11 also depicts a crystal resonator X1 a parallel circuit with two ceramic capacitors C4 and C5. The ON/OFF switch is shown at 46 and the piezo sound device is shown at 72.

Several of the important and unique features of the baseball game of the present invention will now be discussed. It will be appreciated that these features are actually encoded in the computer software associated with the present invention and stored in integrated circuit microprocessor 100. The software is also described in the flow chart diagrams of FIGS. 12A–12I and the source code written in assembly language and attached hereto as a microfiche appendix. A key feature of the present invention is that information encoded on the bar coded baseball cards will interact with and be integrated into the baseball gameplay as defined in the stored computer software.

BATTING AVERAGE

Each batter has encoded on bar code 96 of baseball card 88 the correct batting average as printed on card 88. Batting averages will have a range between ".100" and ".499". These averages translate into eight effective ranges to determine the percentages of successful hits as follows:

TABLE 1

| | |
|---|---|
| Group 8 | .350–.399 or above |
| Group 7 | .325–.349 |
| Group 6 | .290–.324 |
| Group 5 | .275–.289 |
| Group 4 | .250–.274 |
| Group 3 | .225–.249 |
| Group 2 | .200–.224 |
| Group 1 | .100–.199 |

The higher the group, the better percentage for successful hits. Batting averages are displayed on LCD scoreboard 32 as three digit numbers with a leading decimal point. Runner on first is identified by speed value only.

POWER FEATURE

Power hitters are those hitters who get more "extra base hits" (doubles, triples, and Home Runs). When the bar code 96 of a batter card 88 is encoded for Power Hit, the distribution for extra base hits is increased.

HANDEDNESS FEATURE:

When the pitcher and batter have opposite handedness codes, the batter's effective average will be as coded. When the handedness is the same, the effective batting average is one group lower. This does not effect the power feature described above.

STEAL, PICK-OFF FUNCTIONS

Steal key 50 allows a runner on first base to "steal second". It effects only a runner at first base when there is no runner at second base. Steal is not permitted with a man on second. A pick-off is not permitted once the pitcher starts his wind-up (pitch direction key 62 or 64 pressed). The following gives the results of all steal and pickoff conditions:

a) Pick-off Key 50 pressed and no steal: 1st Baseman only is displayed for 1.5 seconds along with the ball sequence simulating; 1 a throw to first.

b) Steal Key 50 pressed before pitcher starts windup: Runner on first (see item 204 in FIG. 7) starts to steal (moves to next runner position 206 with runner sound). Runner moves at same rate as base runner moves for batted ball. If pitching team presses Pick-off Key 50 before runner gets to the second base runner position 208, the runner is out; if not, runner is safe.

c) Steal Key 50 pressed after the windup is started (leg position 210 turned on): There is a timed window consisting of 3 ranges during the time when the pitcher's leg position 210 is visable and ending with the first pitched ball displayed. If the Steal Key 50 is pressed coincidently or just after the pitcher starts his windup, the percentage of success is highest. If the Steal Key is pressed just before the first pitched ball is displayed, the success is lowest. After the first pitched ball is displayed, the success rate is close to 0%.

d) The speed of the base runner as encoded in the bar code 96 of card 88 or standard team will alter the success rate derived from (c): A fast Runner increases the resulting percentage by 20%.

e) The speed and type of pitch selected will alter the success rate derived from (c) and (d) as follows:

Fast, non curve pitch decreases the success percentage by 20%.

Fast curve, no change.

Medium or slow pitch increases 5% and,

Medium or slow curve increases 10%.

f) If a steal is in progress and the pitch is hit, the following occurs:

If the batted ball is a "fly out" (for example, 3L, 3R, 5L, 5R), then runner remains on first base.

If the batted ball is a "hit", the runner will get an extra base.

If the batted ball is a "ground out" (for example, 6A, 6B), then runner is on second base and batter is out.

BUNT:

Bunt Key 52 swings the bat the same way as the bat key but limited to middle position 212 when no ball is pitched. The batted ball result matrix is shown below in Table 2. No flyballs to the outfield are permitted. Failed bunt means a forced out or no advance. Good bunt means runners advance and batter is out. Foul ball on the third strike is an out. All bunts are attempted sacrifices (move the runners one base and the batter is out). Sacrifices are successful more often when hit to the right and left and less often when hit to the center. If a sacrifice fails, the lead runner is out and the batter is safe.

TABLE 2

BUNT (FOR ALL BATTING POINTS - When ball is batted using the Bunt Key); Success Percentage Based on Left, Right or Center Ball Path

| | |
|---|---|
| Bunt (14) | 100% (L/R) |
| Failed Sac. | 0% (L/R) |
| Foul (12) | 30% (Center) |
| Bunt (14) | 10% (Center) |
| Failed Sac. | 60% (Center) |

BATTING ORDER

The sequence of cards determines the batting order for each inning. The game does not store the card sequence. Players must check each other to make sure that the correct batting order is followed.

PITCHERS AND RELIEF PITCHERS

While there is no difference in bar code, the pitcher's card (any card) may be used to set the pitcher's lefty/-righty handedness condition, and speed of fastball. To use the card mode, press the Relief Pitcher Key and insert the card. This will enter the handedness of the pitcher and display the pitcher's pitching speed such as 90 (mph) on the scoreboard. A correct read will be marked with a beep as with the batting code. The same bar code 96 is used for both pitching speed and batting average. Pitcher's will have specially contrived batting averages to favor their pitching speed statistics. Since most pitchers bat under .200, a pitcher's batting average (most significant digit) bar code will be coded with the digit "1" or "0" which actually determines the pitch ball speed. When a pitcher bats, the batting average will be displayed as with any other batter. When a card is inserted after pressing the Relief Pitcher Key 54, only the last two digits will be displayed and the most significant digit will determine the pitching speed. For example: A card with a batting average bar code is set at ".092". When the card is inserted after pressing the Relief Pitcher Key 54, the computer reads the batter's average as pitching speed and the display 32 will show "P" "92". When inserted without pressing key 54, the computer reads the batting average normally and the batting average ".092" will be displayed along with the batting position.

After the Relief Pitcher Key 54 is pressed and the card is inserted, both the "Score" and the "Average" legends (indicators) will be turned off, while the letter "P" will be displayed in the right digit of the batting position/inning indicator; the first two digits of the score will be turned off.

Pressing the Relief Pitcher Key 54 will toggle the handedness each time the key is pressed. But if a card is inserted before a pitch is selected, the handedness of the card will be the final result. To change handedness without using a card, simply press the Relief Pitcher Key and pitch without inserting a card.

At the start of the game before any pitch is thrown, the Pitcher will initiate as a Righty. Pressing the Relief Pitcher Key 54 alternates the lefty/righty indicator on each press.

SPEED FEATURE

For all cards including pitchers, the bar code speed value will effect Base Stealing, Sacrifice Flies and double plays only.

PITCHING SPEED

The first (most significant) digit of the batting average bar code will be used to set the pitching speed. "0" for highest and "1" or any other number for lowest speed. Thus, all super fast pitchers will have a batting average under ".100". Normal speed pitchers can have any standard batting average above ".100".

These bar codes will select one of two ranges of speeds for all pitches. If no card is inserted after pressing the Relief Pitcher Key, the handedness will change and the slower of the two speeds will be in effect.

BASE RUNNING (a) A runner will score from third base on a fly to the outfield with less than two outs (Sacrifice Fly) as follows: fast runner 100%, slow runner 70%. Otherwise runner stays on third. (Third out supercedes all scoring).

(b) A runner will score from second on a single to outfield.

(c) A runner will go from first to third on a single to right field.

DOUBLE PLAY (a) Press Double Play Key 52 before pitching to select Double Play option for current batter. If not pressed, lead runner only is forced out on any ground out. Double play key creates simulated double play depth.

(b) Double Play will only effect a runner on first base and the batter (no matter how many runners are on base). When a ground out occurs, with a runner on first base, and Double Play is selected, the following applies: If the batter is fast, Double Play (2 outs) occurs 50%. If the batter is slow, Double Play occurs 80%. If no double play occurs, then a forceout at the highest base occurs (lead runner is out).

STANDARD TEAM

In a preferred embodiment, the present invention includes a hardprogrammed "standard team" with a nine batter line up so that the game may be played without the use of cards, or it can be played with only one team using cards and the other not using cards. This will facilitate a "one player" game where the computer controlled team does not need to have cards. Each player on the standard team has his batting average and handedness displayed in the same manner as with the cards. The power and speed features will also be effective. The "standard team" will have the following statistics:

| BATTING POSITION | BATTING AVERAGE | HANDEDNESS | SPEED | POWER |
|---|---|---|---|---|
| 1 | .300 | L | F | 0 |
| 2 | .285 | R | F | 0 |
| 3 | .320 | R | S | 0 |
| 4 | .274 | L | S | 1 |
| 5 | .265 | R | S | 1 |
| 6 | .250 | L | S | 1 |
| 7 | .283 | L | S | 0 |
| 8 | .230 | R | F | 1 |
| 9 | .194 | R | S | 0 |

SEQUENCE OF OPERATIONS

1. Start: Move power switch 46 to the "on" position. Sound device 72 plays "Take Me Out to the Ball Game" or like song.
2. Select game option: Select "One Player" or "Two Player" using key 48.
3. Card Mode or "Standard Batting Order" will be selected automatically after power up as follows:

After the number of players are selected and the game initializes and the batting position shows "1" for the first batter, the game waits for:

(a) The fist batter card to be inserted (card mode), or (b) The player to press the Bat Key 48. (Standard team mode).

4. At the beginning of a game or after a hit or an out, no batter is displayed on LCD 24. Once a card is inserted and the "correct read" beep is heard, the batting average is displayed on the scoreboard and the batter indicator (214) appears on LCD 24. In the standard team mode, the batting average and the batter are displayed at the same time the batting position number is displayed on the scoreboard.

If a card is inserted for the first batter, then the team at bat will be in the "Card Mode" for the rest of the game. If, after turning on the power, the player "at bat" presses the Bat Key 48 (swings the bat) before a batter card is inserted, then that team (the visiting team) will be in the "Standard Batting Order" mode for the rest of the game. The same applies to the "Home Team" in the second half of the first inning. If they do not insert a card, but press the Bat Key (swing the bat) first, they will be in the "Standard Batting Order". It is possible for either team to be in the "Standard Batting Order" while the other is in the "card mode".

5. Both Home and Visiting pitchers initialize as right-handed, and at the slower speed. In the One Player mode, the Home Team (automatic) pitcher will initialize as a "righty", and automatically start to pitch after a delay. By selecting a Pitcher either by pressing the Relief Pitcher Key 54 alone or by inserting a card after pressing the Key before the first pitch, the player can have either a righty or a lefty as an opponent. The visiting team player can select the handedness of the pitcher in the same manner. After pressing the relief pitcher key 54, the pitcher will disappear and will not reappear until after several seconds or until a pitcher's card is inserted.

After power up before a pitch is thrown, the Relief Pitcher Key 54 may be pressed without limit, thereby changing from right to lefthanded. This key alternates the lefty/righty indicator each press, (and the internal code for determining the effective batting average).

6. After a batter has hit safely or made an out, if the team at bat is in the Card Mode, instead of the pitcher starting automatically, the game will wait for a card to be inserted:

a) Manual Pitcher: In the Two Player Mode or, in the One Player Mode and the Visiting Team (operator controlled pitcher) is pitching, the pitching controls will be "locked out" until a batting card is inserted and the "correct read" beep is heard, and the batting average is displayed on the scoreboard. After that, the pitching keys will be "unlocked".

b) Automatic Pitcher: If the game is in the One Player Mode and the Home Team (automatic pitcher) is pitching, the pitcher will wait for the card to be inserted and the "correct read" beep is heard, and the batting average is displayed on the scoreboard. The pitcher will start to pitch thereafter.

BATTED BALL

Figure 7:
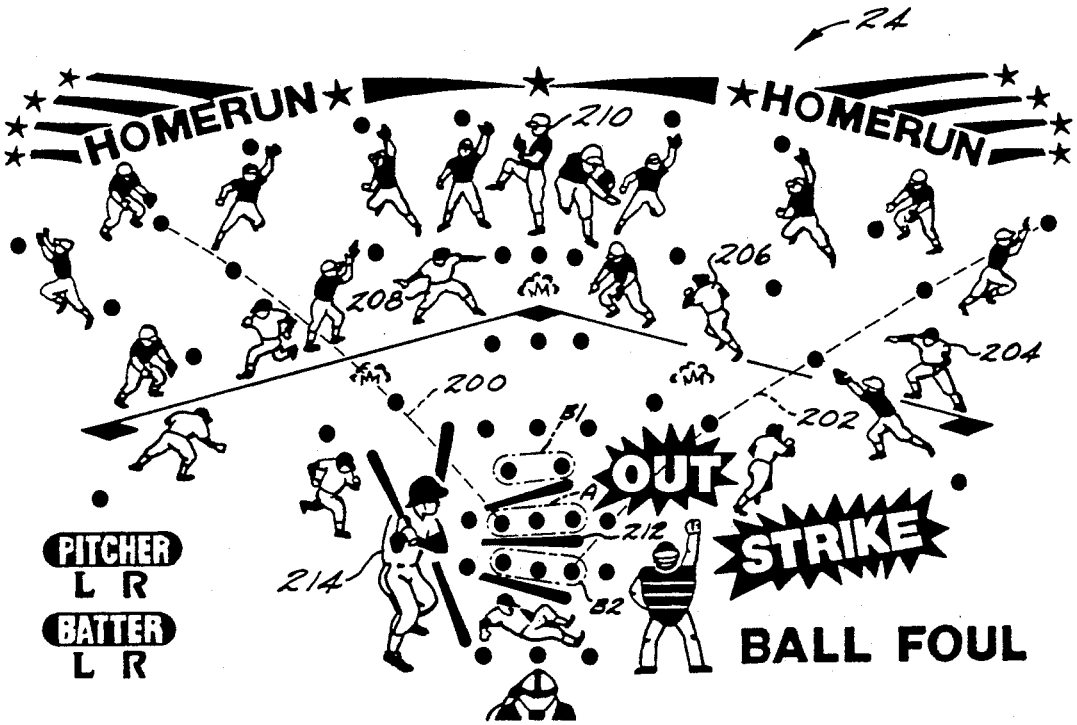
FIG. 7 is a plan view of the baseball playing field LCD display.
Figure 8:
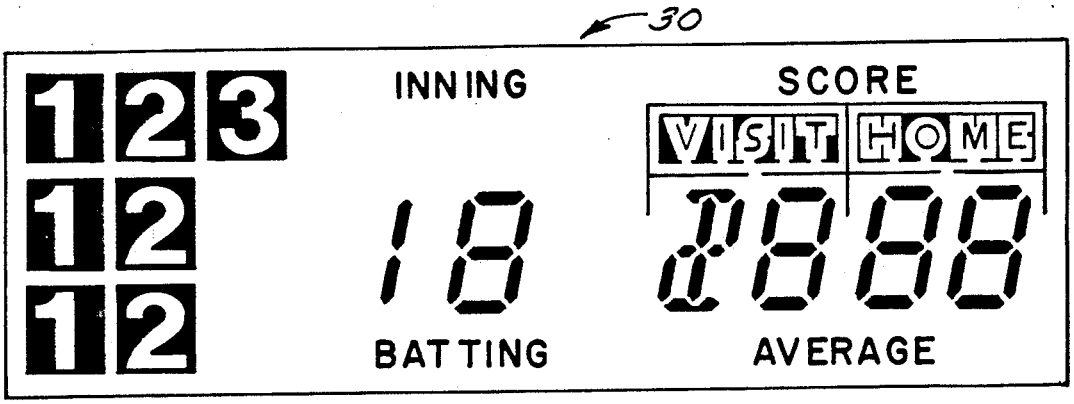
FIG. 8 is a plan view of the scoreboard LCD display.

Referring to FIG. 7, a ball is batted ("hit") when both bat and ball are in position A, $B_1$ or $B_2$ only.

For each batting point of A, $B_1$, $B_2$ (duration of visible ball), the batting point is divided into a two part timing window. The early part of the timing window is "Just Timing" and the late part is "Out of Timing". The results of contact in A, $B_1$, and $B_2$ are determined as per Batted Ball Matrix of Table 3.

The batting average groups described above are used to determine the percentage of hits. Therefore, there are eight different percentage groups. There also is a "Power" factor which if a batter is a "Power Hitter", the percentage of Home Runs increase, while "Outfield Grounder" decreases.

TABLE 3

BATTED BALL MATRIX

| | | 1 | 2 | 3 | 4 | 5 | 6 | 7 | 8 |
|---|---|---|---|---|---|---|---|---|---|
| $B_2$ | Home Run (1) | 6.0 | 6.4 | 7.0 | 7.4 | 7.8 | 8.4 | 9.0 | 10.0 |
| & | Power | 12 | 12.8 | 14 | 14.8 | 15.6 | 16.8 | 18 | 20 |
| A | Triple/Double (2L): | 6.0 | 6.4 | 7.0 | 7.4 | 7.8 | 8.4 | 9.0 | 10.0 |
| JUST | 3BH, 2BH | | | | | | | | |
| TIM- | Outfield Fly (3L): | 70 | 68 | 65 | 63 | 61 | 58 | 55 | 50 |
| ING | Out or 1BH (50/50) | | | | | | | | |
| | Outfield Grounder (4L) | 18 | 19.2 | 21 | 22.2 | 23.4 | 25.24 | 27 | 30 |
| | 1BH or 2BH/Power | 12 | 12.8 | 14.8 | 15.6 | 16.8 | 18 | 20 | |

TABLE 3-continued

| BATTED BALL MATRIX | | | | | | | | | |
|---|---|---|---|---|---|---|---|---|---|
| | (50/50) | | | | | | | | |
| OUT OF TIM-ING | Infield Fly (5L): Out | 32 | 20 | 14 | 12 | 6 | 4 | 3 | 1 |
| | Infield Grounder: Out or 1BH (6A, 6B) 70% 30% 30%, 70% | 38 | 50 | 56 | 63 | 69 | 73 | 80 | 88 |
| | Foul Left (12) | 30 | 30 | 30 | 25 | 25 | 23 | 17 | 11 |
| | | Batting Average Group | | | | | | | |
| | | 1 | 2 | 3 | 4 | 5 | 6 | 7 | 8 |
| $B_1$ JUST TIM-ING | Home Run (1) | 6.0 | 6.4 | 7.0 | 7.4 | 7.8 | 8.4 | 9.0 | 10.0 |
| | Power | 12 | 12.8 | 14 | 14.8 | 15.6 | 16.8 | 18 | 20 |
| | Triple/Double (2R): 3BH, 2BH | 6.0 | 6.4 | 7.0 | 7.4 | 7.8 | 8.4 | 9.0 | 10.0 |
| | Outfield Fly (3R): Out or 1BH | 70 | 68 | 65 | 63 | 61 | 58 | 55 | 50 |
| | Outfield Grounder (4R) | 18 | 19.2 | 21 | 22.2 | 23.4 | 25.24 | 27 | 30 |
| | 1BH or 2BH/Power | 12 | 12.8 | 14.8 | 15.6 | 16.8 | 18 | 20 | |
| OUT OF TIM-ING | Infield Fly (5R): Out | 32 | 20 | 14 | 12 | 6 | 4 | 3 | 1 |
| | Infield Grounder: Out or 1BH (6A, 6B) | 38 | 50 | 56 | 63 | 69 | 73 | 80 | 88 |
| | Foul Right (12) | 30 | 30 | 30 | 25 | 25 | 23 | 17 | 11 |

NOTE:
(1) All effective batting averages for this chart are computed at the highest number for each group plus 100 points.
(2) Batting averages are based averages set forth in Table 1.

Figure 12A:
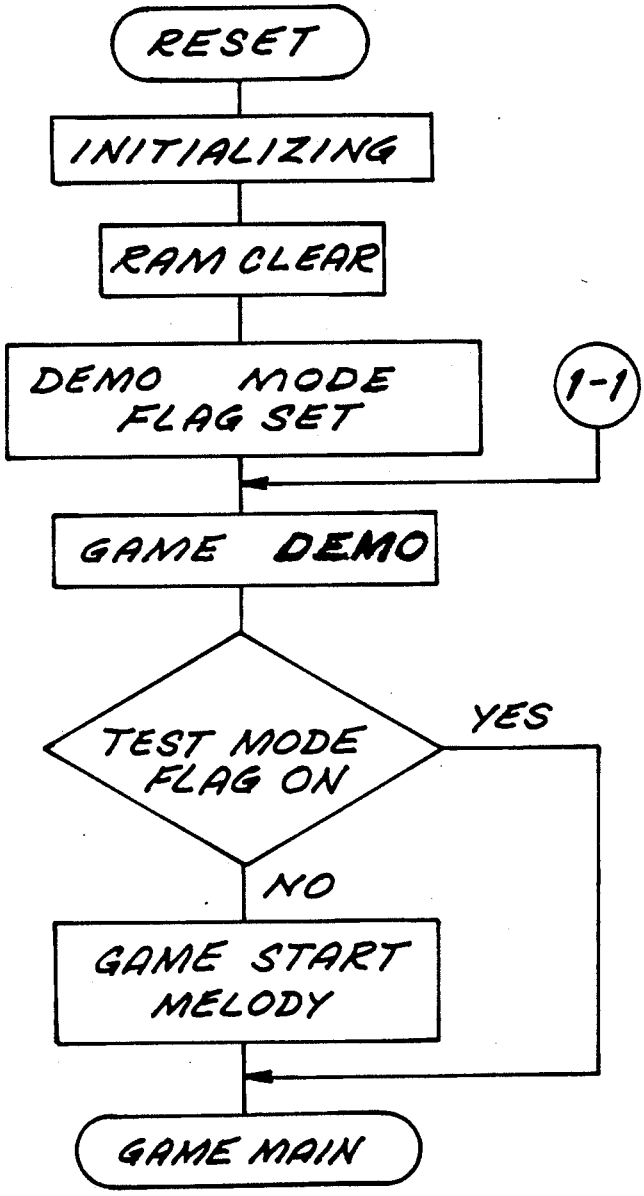
FIGS. 12A-12I are flow charts depicting the computer software used in the baseball game of FIG. 1.
Figure 12B:
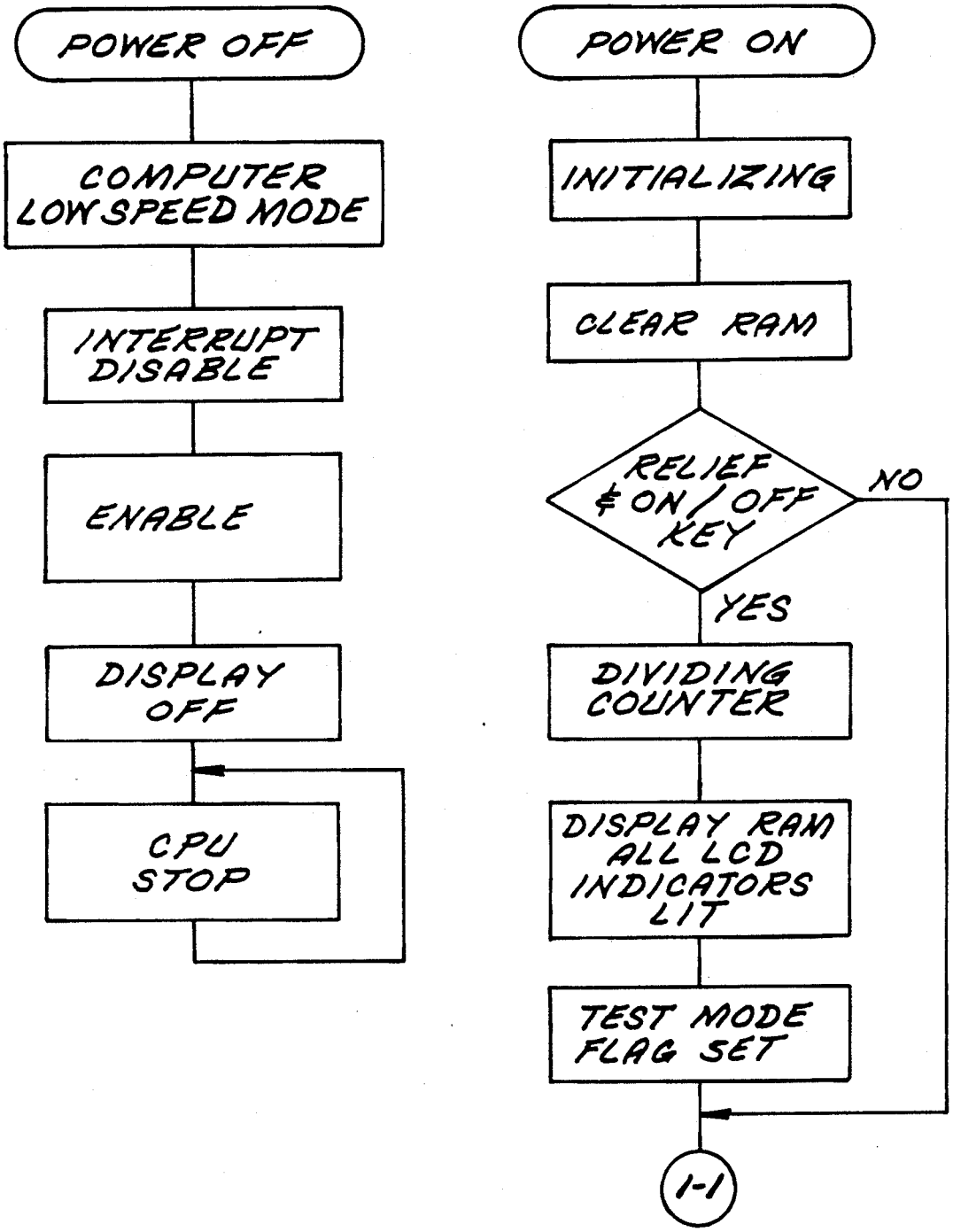
Figure 12C:
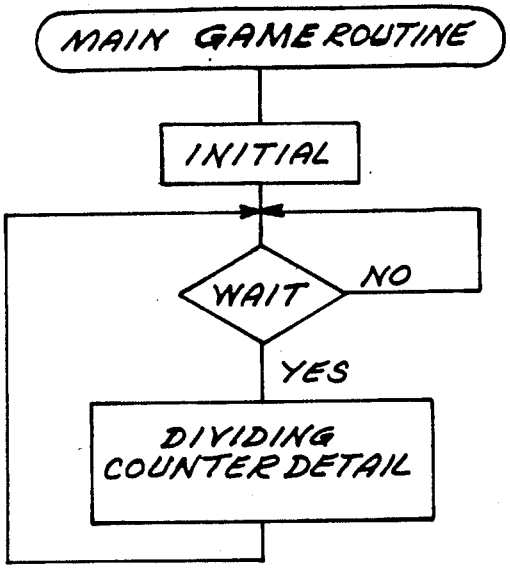
Figure 12E:
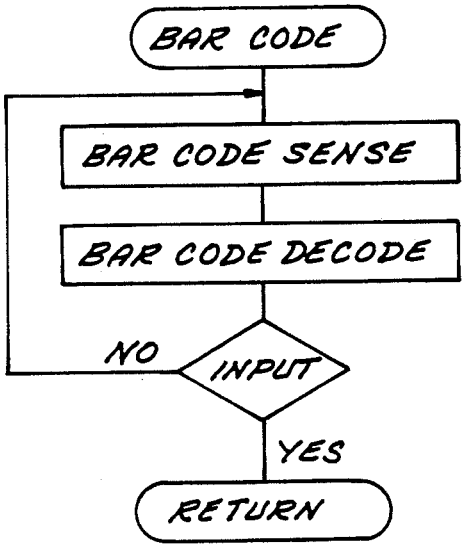
Figure 12I:
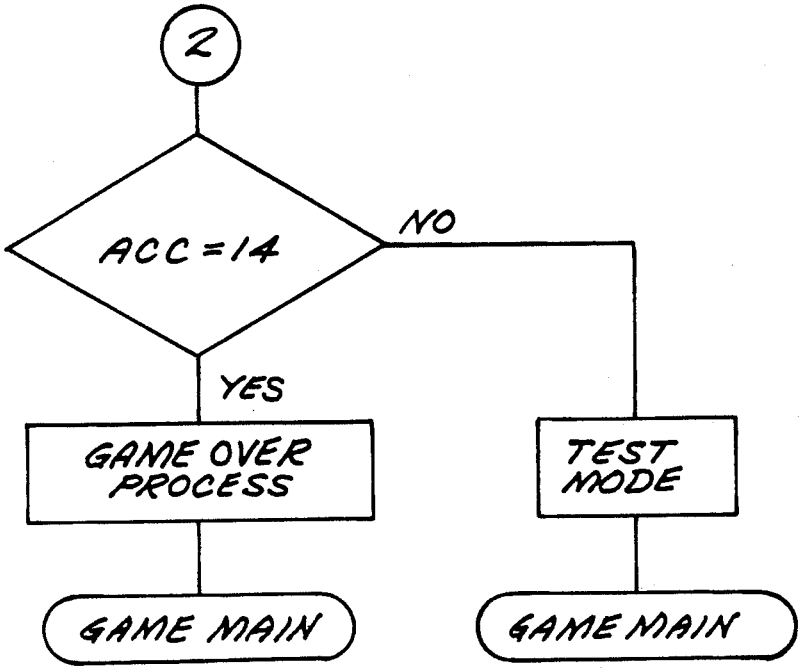
Figure 12D:
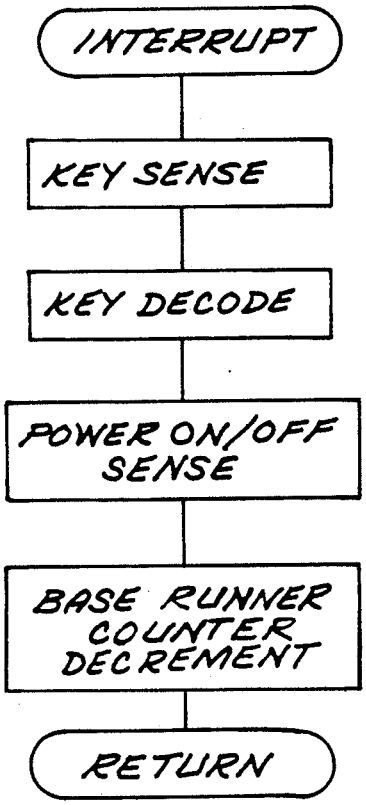
Figure 12F:
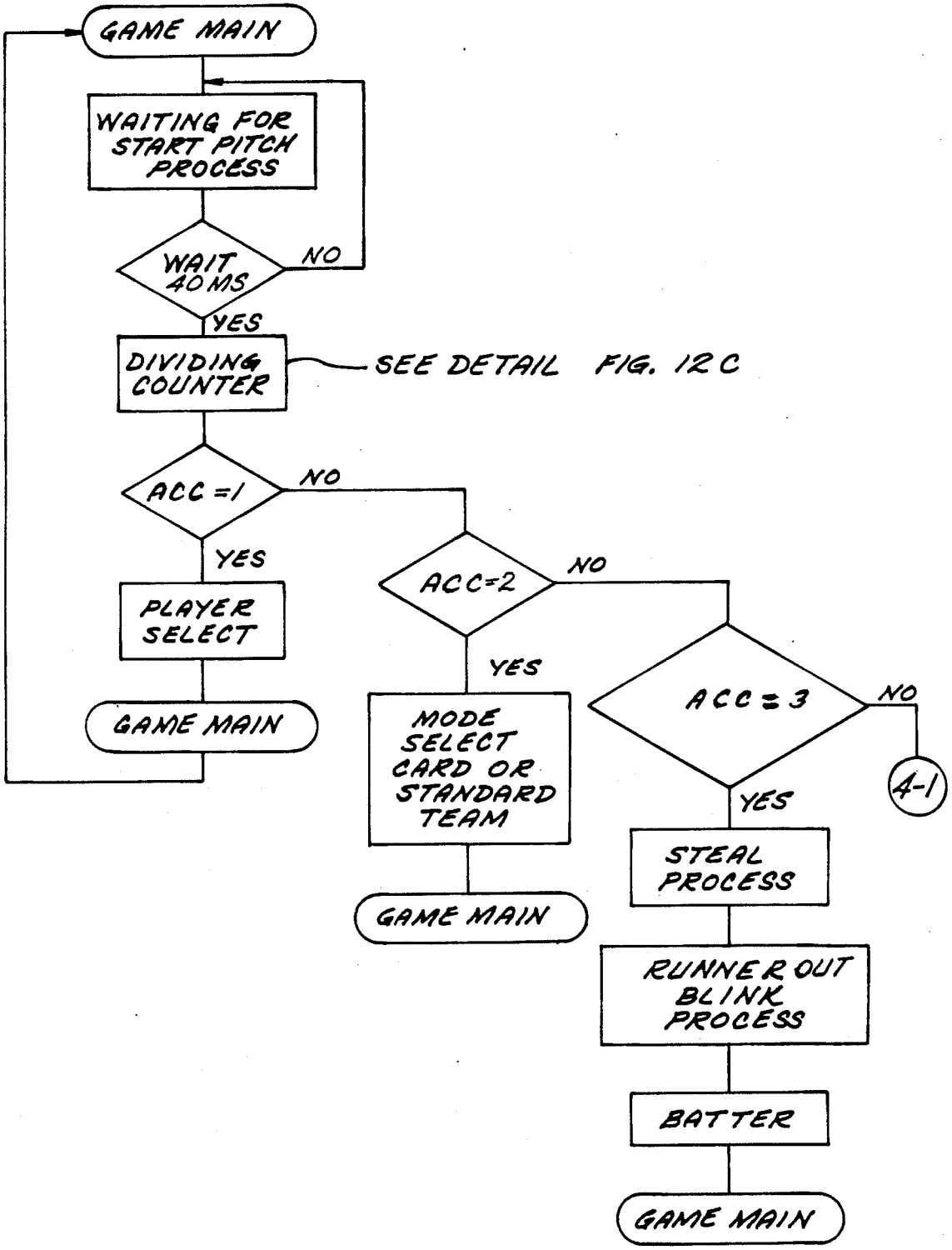
Figure 12G:
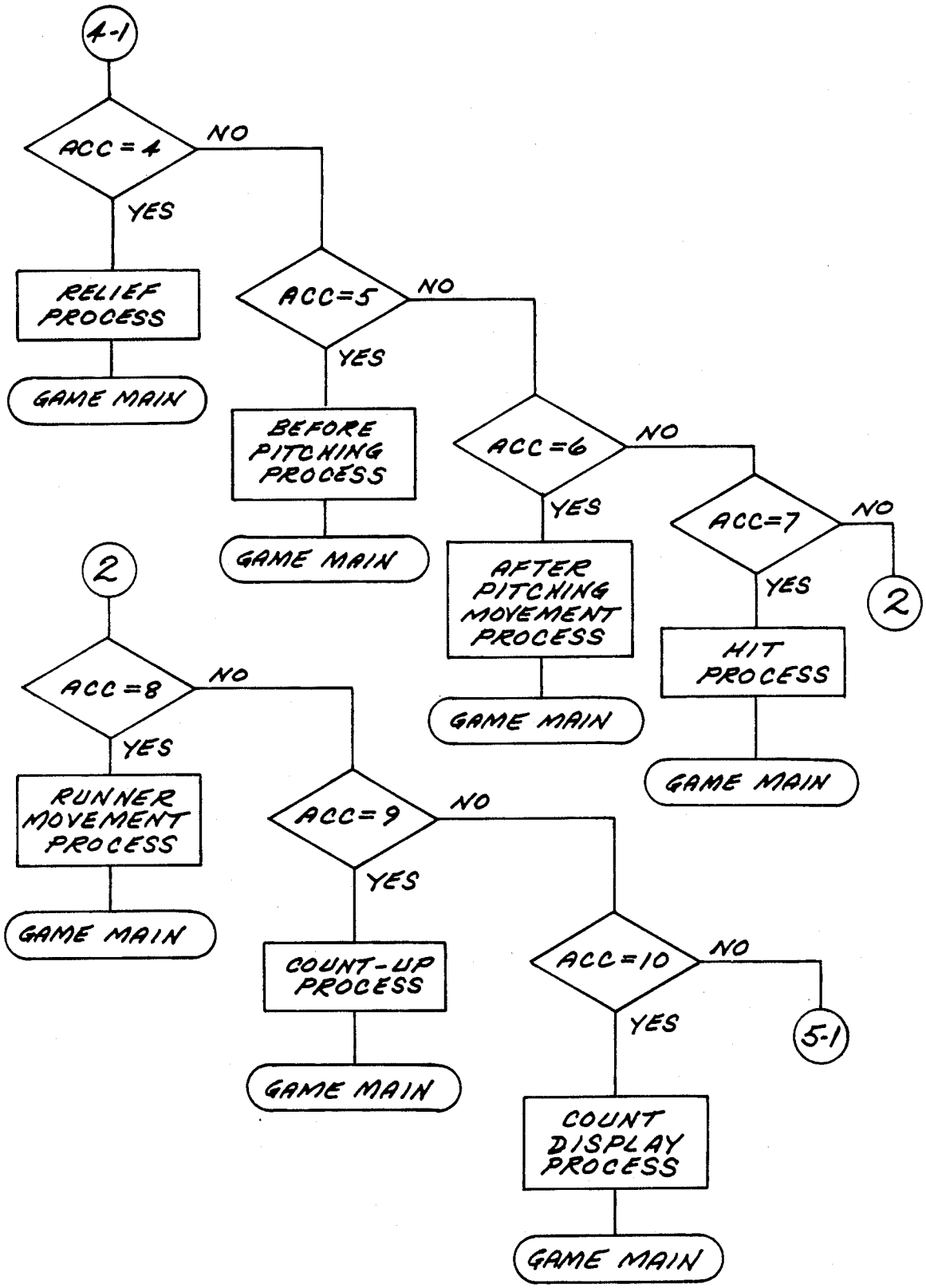
Figure 12H:
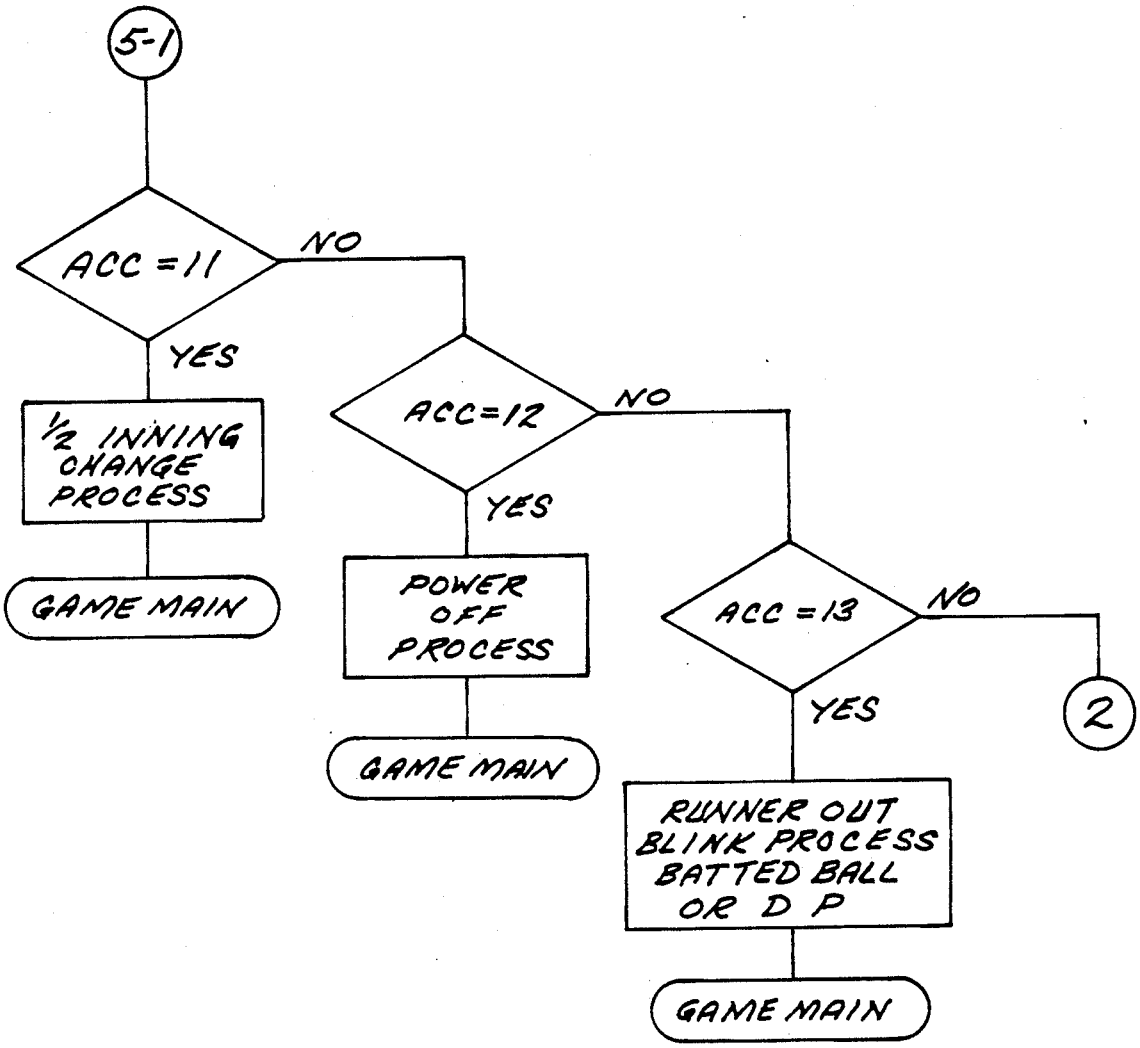

The flow charts of FIGS. 12A–12I will be appreciated and understood by a person of ordinary skill in the art from the foregoing description of the game features and sequence of operation. However, a summarized review of the flow charts now follows. FIG. 12A relates to a first initialization sequence where the game is turned on upon power-up of the batteries and a start-up melody (TAKE-ME-OUT-TO-THE-BALLGAME) commences. Demo mode turns on all of the LCD displays and runs through a computer game simulation. FIG. 12B relates to a power down sequence and a second or standard initialization where the game is turned on using the relief ON/OFF key and where a second test mode is run by the computer program which turns on all indicators on the LCD playing field through a test mode sequence. FIG. 12C is a detailed flow chart of the divider counter detail where the game is in a stand-by mode waiting for a key depress or bar code sequence. FIG. 12D depicts the interrupt cycle detail where key depressions are sampled every 7.82 ms in accordance with a timer. FIG. 12E is a flow chart of a subroutine for the bar code sensing and decoding steps.

In FIGS. 12F, 12G, 12H and 12I, a flow chart is presented of the program for effecting the various features described above including use of statistics from cards or standard team, pitching, runner movement, batting, stealing, pick-off, bunting, relief pitching, running speed, pitching speed and double play, all of which have been described above.

A key feature of the present invention is the use of baseball cards or the like as supplimentary programmable means to enter information which effect the game play interactively with the operator.

It will be appreciated that the game play of the present invention will thus be affected by three elements including (1) the skill of the baseball player as encoded in the bar code; (2) the skill of the human game operator; and (3) the interaction between the baseball player and human operator. This leads to an electronic baseball game which offers superior game play to any games heretofore known.

Of course, while in a preferred embodiment, the statistical information for each baseball player is encoded in a bar code format, which is printed on a self sticking tape which can readily be affixed to a card and also removed. Any other means of electronically storing information may be used in connection with this invention. For example, the bar code may be replaced with magnetic tape or a pattern of apertures or notches. However, the bar code storage method is preferred in view of its low cost and low likelihood of becoming damaged, and its ease of being changed from year to year.

Similarly, while the present invention has been described as a self contained electronic game employing LCD display means, any other electronic visual display means may be used including LED or video.

The present invention is also contemplated for use in other electronic sports games such as football, basketball, soccer or hockey. All of these games may similarly utilize a key feature of this invention wherein player's attributes and skill levels (which may be in the form of statistical player information) encoded on a card or other input means is electronically read into the game as a supplimentary programmable means so as to interact with and effect the overall game play.

The present invention may be easily distinguished from prior art electronic games which employ either a keyboard or a cartridge. In a keyboard only game, each key inputs a single piece of information to the stored computer program at a given moment in the game play. In a cartridge, the cartridge inputs all of the information for the computer program for the entire game play. In contrast, the input means (e.g. card) of this invention utilizes encoded information (e.g. bar code) which inputs supplementary information for interaction with the primary computer program for use over a portion of the game play.

All percentages presented hereinabove are based on a free running random number generator and are defined statistically in a known manner.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An electronic sports game having a preselected game play comprising:

housing means;

at least one input means having at least one specific player's encoded skill information thereon;

electronic sensor means in said housing means for reading said encoded player's information from said input means; and control means for integrating said encoded player's information received from said electronic sensor means into the game play of the sports game.

2. The electronic game of claim 1 wherein:

said encoded information comprises a bar code; and said electronic sensor means comprises bar code sensor means.

3. The electronic game of claim 2 including:

a slot in said housing means, said bar code sensor means communicating with said slot, said slot being dimensioned to receive said input means therein whereby said bar code on said input means is read by said bar code sensor means.

4. The electronic game of claim 2 wherein:

said bar code is printed on an adhesive sticker, said sticker being applied to said input means.

5. The electronic game of claim 1 including:

support means in said housing means for supporting, displaying and storing at least one input means.

6. The electronic game of claim 1 including:

display means communicating with said control means.

7. The electronic game of claim 6 wherein:

said display means is positioned on said housing means.

8. The electronic game of claim 6 wherein:

said display means comprises a liquid crystal display.

9. The electronic game of claim 1 including:

sound generator means in said housing means communicating with said control means.

10. The electronic game of claim 1 wherein said game play comprises the game of baseball and said input means comprise baseball card means and including:

visual display means, said visual display means depicting a baseball field including an infield having a first base, second base, third base and home plate and an outfield, said visual display means further selectively indicating nine defensive players including a pitcher and selectively indicating one offensive player defining a batter, said visual display means further including;

(1) means for indicating a pitched ball from the pitcher to the batter;

(2) means for selectively indicating travel of a ball after a pitched ball has been batted;

(3) means for selectively indicating advance of the batter along a base path after the batter has successfully batted a pitched ball to make a single, double, triple or homerun;

pitching means for selectively pitching a ball; and batting means for selectively batting a pitched ball.

11. The electronic game of claim 10 wherein:

said player skill information includes at least one of the player characteristics selected from the group consisting of left or right handedness, batting average, running speed, batting power and pitching speed.

12. The electronic game of claim 10 including:

scoreboard display means communicating with said control means.

13. The electronic game of claim 12 wherein:

said scoreboard display means selectively displays at least one of the informational subjects selected from the group consisting of strikes, balls, outs, inning, score, batting position, team at bat and batting average.

14. The electronic game of claim 10 wherein said player skill information includes batting average and wherein:

an individual player's encoded batting average is placed in one of a plurality of batting average groups in a range of 0.100 to 0.499.

15. The electronic game of claim 14 wherein said player skill information includes left or right handedness and wherein:

an individual player's encoded batting average is lowered when a pitcher pitching to the individual player has the same handedness as the individual player.

16. The electronic game of claim 10 wherein said player skill information includes batting power and wherein:

an individual player encoded for batting power is more likely to hit a double, triple or home run as compared to an individual player not encoded for batting power.

17. The electronic game of claim 10 wherein said visual display means indicates a pitcher's wind-up and subsequent release of a pitched ball and including:

steal key means for allowing a base runner at a base to steal another base, the base runner successfully stealing another base being dependent on the timing as observed by the position of a pitcher in the pitcher's wind-up and subsequent release of a pitched ball.

18. The electronic game of claim 17 wherein said player skill information includes running speed and wherein:

an individual player encoded for a faster running speed is more likely of successfully stealing second base as compared to an individual player not encoded for a slower running speed.

19. The electronic game of claim 17 wherein:

an individual player successfully stealing a base is also dependent on the speed and type of pitch pitched by the pitcher.

20. The electronic game of claim 10 including:

pick-off key means for picking off a runner at first base.

21. The electronic game of claim 10 including:

bunt key means for permitting a batter to bunt a pitched ball.

22. The electronic game of claim 10 including:

double play key means for bringing the fielding team into simulated double play depth, thereby producing a potentiality for the batting team to hit into a double play.

23. The electronic game of claim 10 wherein said player skill information includes running speed and wherein:

an individual player encoded for running speed effects game play action of base stealing, sacrifice flies and double plays.

24. The electronic game of claim 10 including:
pitch selection key means for selecting a type of pitch.

25. The electronic game of claim 24 wherein:
said type of pitch is selected from the group consisting of change-up, off-speed and fast ball.

26. The electronic game of claim 24 including:
pitch direction key means for determining the deflection of a pitched ball.

27. The electronic game of claim 24 including a pitch direction key means for determining the deflection of a pitched ball and wherein:
said pitch selection key means and said pitch direction key means comprise a plurality of wedged shaped switches arranged in a circle.

28. The electronic game of claim 10 including:
pitch direction key means for determining the deflection of a pitched ball.

29. The electronic game of claim 10 wherein said control means includes a memory and further including:
a standard team of at least nine players in said memory, each of said nine players being encoded with pre-selected player skill information.

30. The electronic game of claim 29 wherein:
said standard team is encoded with player skill information including at least one of the player characteristics selected from the group consisting of batting, average, left or right handedness, running speed and batting power.

31. The electronic game of claim 10 wherein:
the success of a batted ball being dependent on the position, and duration of that position, of the pitched ball at the moment the pitched ball is batted.

32. The electronic game of claim 10 wherein:
said visual display means indicates a batter only after said encoded player information on said input card means has been received by said control means.

33. The electronic game of claim 10 including:
relief pitcher key means for selectively removing a pitcher from said visual display means with another pitcher being indicated on said visual display means only after input card means has been received by said control means.

34. The electronic game of claim 1 wherein:
said input means comprises input card means.

* * * * *